US009940763B2

(12) United States Patent
Nagata et al.

(10) Patent No.: US 9,940,763 B2
(45) Date of Patent: Apr. 10, 2018

(54) ON-VEHICLE APPARATUS CONTROL SYSTEM, ON-VEHICLE CONTROL DEVICE, AND PORTABLE MACHINE

(71) Applicants: Tatsuki Nagata, Aichi (JP); Masato Kashiyama, Aichi (JP)

(72) Inventors: Tatsuki Nagata, Aichi (JP); Masato Kashiyama, Aichi (JP)

(73) Assignee: OMRON AUTOMOTIVE ELECTRONICS CO., LTD., Aichi (JP)

( * ) Notice: Subject to any disclaimer, the term of this patent is extended or adjusted under 35 U.S.C. 154(b) by 0 days.

(21) Appl. No.: 15/456,780

(22) Filed: Mar. 13, 2017

(65) Prior Publication Data

US 2017/0352206 A1 Dec. 7, 2017

(30) Foreign Application Priority Data

Jun. 6, 2016 (JP) ..... 2016-112929

(51) Int. Cl.
*G07C 9/00* (2006.01)

(52) U.S. Cl.
CPC ..... *G07C 9/00007* (2013.01); *G07C 9/00309* (2013.01); *G07C 2009/00769* (2013.01)

(58) Field of Classification Search
CPC ..... G07C 9/00007; G07C 9/00309; G07C 9/00111
USPC ..... 340/5.6–5.65
See application file for complete search history.

(56) References Cited

U.S. PATENT DOCUMENTS 6,850,148 B2 2/2005 Masudaya
7,283,034 B2 * 10/2007 Nakamura ..... B60R 25/246 340/5.2
7,629,876 B2 12/2009 Nagai et al.
8,565,936 B2 * 10/2013 Kato ..... G07C 5/008 701/2

FOREIGN PATENT DOCUMENTS

JP 2002-247656 A 8/2002
JP 2003-13644 A 1/2003
JP 2008-45374 A 2/2008

* cited by examiner

*Primary Examiner* — Allen T Cao
(74) *Attorney, Agent, or Firm* — Osha Liang LLP

(57) ABSTRACT

An on-vehicle apparatus control system includes: an on-vehicle control device; and a portable machine. The on-vehicle apparatus control system includes: a mode switching unit that selects a permission mode or a prohibition mode; and an illegality recording portion that records transmission or reception of a response request signal as illegality history in a case where the response request signal is transmitted from the on-vehicle control device or is received by the portable machine during the prohibition mode. If the response request signal is received by the portable machine during the permission mode, the portable machine transmits the response signal. If the response request signal is received by the portable machine during the prohibition mode, the portable machine transmits an illegality notification signal instead of the response signal, and the on-vehicle control device does not control an on-vehicle apparatus if the illegality notification signal is received.

10 Claims, 8 Drawing Sheets

[PASSIVE ENTRY]

[PASSIVE ENTRY]

FIRST RESPONSE REQUEST SIGNAL (LF)

FIRST ILLEGALITY NOTIFICATION SIGNAL (UHF)

SECOND RESPONSE REQUEST SIGNAL (LF)

SECOND ILLEGALITY NOTIFICATION SIGNAL (UHF)

[POLLING]

ON-VEHICLE APPARATUS CONTROL SYSTEM, ON-VEHICLE CONTROL DEVICE, AND PORTABLE MACHINE

CROSS-REFERENCES TO RELATED APPLICATIONS

This application is based upon and claims the benefit of priority from Japanese Patent Application No. 2016-112929, filed on Jun. 6, 2016, the entire contents of which are incorporated herein by reference.

FIELD

One or more embodiments of the present invention relate to an on-vehicle apparatus control system in which an on-vehicle apparatus mounted on a vehicle is controlled on the basis of radio signals which are transmitted and received between an on-vehicle control device mounted on the vehicle and a portable machine carried by a user.

BACKGROUND

There is an on-vehicle apparatus control system in which control of an on-vehicle apparatus is performed, such as locking and unlocking of a door of a vehicle on the basis of radio signals which are transmitted and received between an on-vehicle control device mounted on the vehicle and a portable machine carried by a user. Communication methods between the on-vehicle control device and the portable machine are roughly classified into three methods such as a polling method, a passive entry method, and a keyless entry method.

In the polling method, the on-vehicle control device transmits a response request signal at a predetermined cycle regardless of a position of the portable machine. If the response request signal is received, the portable machine returns a response signal to the on-vehicle control device. In the passive entry method, for example, when a user comes close to or comes into contact with a door knob of a vehicle, a passive request switch provided on the vehicle is turned on, and the on-vehicle control device transmits a response request signal to the portable machine. If the response request signal is received, the portable machine returns a response signal to the on-vehicle control device. In the keyless entry method, a response request signal is not transmitted from the on-vehicle control device to the portable machine, and, when the user operates the portable machine, a remote control signal is transmitted to the on-vehicle control device from the portable machine. In any case, if the response signal or the remote control signal is received from the portable machine, the on-vehicle control device performs collation of an ID code included in the signal. If the collation is successful, the on-vehicle control device locks or unlocks a door of the vehicle.

In a case of the polling method or the passive entry method, for example, illegal communication may be performed in which the portable machine which is far away imitates a state of being in close proximity to a vehicle as a result of a relay relaying a response request signal transmitted from the on-vehicle control device and the portable machine receiving the response request signal. The illegal communication using the relay is called relay attack. A malicious third party who is not an owner of a vehicle may commit a crime such as theft of the vehicle by unlocking a door of the vehicle or starting an engine through the relay attack.

Therefore, regarding crime prevention countermeasures against the relay attack, for example, in JP-A-2003-13644, in the passive entry method, an on-vehicle control device (on-vehicle receiver) measures a period of time from transmission of a response request signal to reception of a response signal with clocking means. Only in a case where a clocked value in the clocking means is within an effective clocked value set in advance when the response signal is received, the response signal is recognized as a normal response signal, and thus a door of a vehicle is locked or unlocked.

In JP-A-2008-45374, a portable machine can select a full mode in which an operation of receiving a polling type response request signal is continuously performed or a power saving mode in which the reception operation is stopped on the basis of an operation on an operation unit of the portable machine or a special command transmitted from a dedicated tool.

In JP-A-2002-247656, a portable machine can select a permission mode in which a response signal to a polling type response request signal is permitted to be transmitted or a prohibition mode in which transmission of the response signal is prohibited on the basis of an operation on an operation switch of the portable machine. The portable machine notifies a user of the present mode through lighting of an LED on the basis of the operation on the operation switch.

As in JP-A-2003-13644, JP-A-2008-45374, and JP-A-2002-247656, in the related art, in a case where relay attack is performed, a door is not locked or unlocked by restricting communication of or a process in the portable machine or the on-vehicle control device.

SUMMARY

However, in the related art, in a case where relay attack using a relay is performed, since traces thereof are not left in the on-vehicle control device or the portable machine, a user is not aware of a vehicle thereof being targeted by a malicious third party, and thus cannot take appropriate actions.

One or more embodiments of the present invention stop relay attack and leave traces of the relay attack.

In accordance with one aspect of the present invention, an on-vehicle apparatus control system includes an on-vehicle control device mounted on a vehicle and a portable machine carried by a user. The on-vehicle control device transmits a response request signal, and the portable machine transmits a response signal if the response request signal is received. If the response signal is received, the on-vehicle control device controls an on-vehicle apparatus mounted on the vehicle on a basis of the response signal. In this configuration, the on-vehicle apparatus control system includes a mode switching unit that selects a permission mode or a prohibition mode; and an illegality recording portion that records transmission or reception of the response request signal as illegality history in a case where the response request signal is transmitted from the on-vehicle control device or is received by the portable machine during the prohibition mode. If the response request signal transmitted from the on-vehicle control device is received by the portable machine during the permission mode, the portable machine transmits the response signal. If the response request signal transmitted from the on-vehicle control device is received by the portable machine during the prohibition mode, the portable machine transmits an illegality notification signal instead of the response signal. The on-vehicle control device does not control the on-vehicle apparatus if the illegality notification signal is received.

In accordance with another aspect of the present invention, an on-vehicle control device mounted on a vehicle includes: a transmission unit that transmits a response request signal to a portable machine carried by a user; a reception unit that receives a response signal transmitted from the portable machine in response to reception of the response request signal; and a control unit that controls an on-vehicle apparatus mounted on the vehicle on a basis of a response signal if the reception unit receives the response signal. The control unit controls the on-vehicle apparatus on a basis of the response signal if the response signal transmitted from the portable machine in response to the response request signal is received when the portable machine is in a permission mode. The control unit does not control the on-vehicle apparatus if an illegality notification signal transmitted from the portable machine in response to the response request signal is received when the portable machine is in a prohibition mode. The on-vehicle control device further includes an illegality recording portion that records illegality history on a basis of the illegality notification signal.

In accordance with yet another aspect of the present invention, a portable machine carried by a user of a vehicle includes: a reception unit that receives a response request signal transmitted from an on-vehicle control device mounted on the vehicle; a transmission unit that transmits a response signal for the on-vehicle control device controlling an on-vehicle apparatus mounted on the vehicle to the on-vehicle control device. The portable machine further includes a mode switching unit that selects a permission mode or a prohibition mode. The transmission unit transmits the response signal to the on-vehicle control device if the response request signal is received during the permission mode, and transmits an illegality notification signal for the on-vehicle control device recording illegality history to the on-vehicle control device instead of the response signal if the response request signal is received during the prohibition mode.

According to the aspect, when a user does not use a vehicle, the mode switching unit performs switching to the prohibition mode. Thus, even if a malicious third party performs relay attack using a relay, and thus a response request signal is transmitted from the on-vehicle control device or is received by the portable machine, the portable machine transmits an illegality notification signal instead of the response signal. If the illegality notification signal is received, the on-vehicle control device does not control an on-vehicle apparatus, and thus it is possible to stop the relay attack. In a case where the response request signal is transmitted from the on-vehicle control device or is received by the portable machine during the prohibition mode, illegality history is recorded in the illegality recording portion, and thus it is possible to leave a trace of the relay attack.

In accordance with the aspects of the present invention, the on-vehicle apparatus control system may further include an illegality notification unit that generates a notification indicating that there is illegality in a case where the response request signal is transmitted from the on-vehicle control device or is received by the portable machine during the prohibition mode.

In accordance with the aspects of the present invention, in the on-vehicle apparatus control system, the mode switching unit may include an operation switch provided in the portable machine, and select the permission mode or the prohibition mode through a predetermined operation on the operation switch.

In accordance with the aspects of the present invention, in the on-vehicle apparatus control system, the illegality recording portion and the illegality notification unit may be provided in the on-vehicle control device, the illegality recording portion may record a situation of receiving the illegality notification signal in the on-vehicle control device as the illegality history, and the illegality notification unit may generate the notification indicating that there is illegality on a basis of the recorded content in the illegality recording portion.

In accordance with the aspects of the present invention, in the on-vehicle apparatus control system, in a case where a number of times of reception of the illegality notification signal recorded in the illegality recording portion is equal to or more than a predetermined number, the illegality notification unit may output a warning.

In accordance with the aspects of the present invention, in the on-vehicle apparatus control system, when the on-vehicle control device receives the response signal, the illegality notification unit may generate a notification of the illegality history recorded in the illegality recording portion.

In accordance with the aspects of the present invention, in the on-vehicle apparatus control system, the on-vehicle control device may initially transmit a first response request signal, transmit a second response request signal if the illegality notification signal is received in response to the first response request signal, and record the illegality history in the illegality recording portion if the illegality notification signal is received in response to the second response request signal.

In accordance with the aspects of the present invention, in the on-vehicle apparatus control system, a format of the second response request signal transmitted from the on-vehicle control device may be different from a format of the first response request signal, and a signal length of the second response request signal may be smaller than a signal length of the first response request signal.

According to one or more embodiments of the present invention, it is possible to stop relay attack and also to leave a trace of the relay attack.

DETAILED DESCRIPTION

Figure 1:
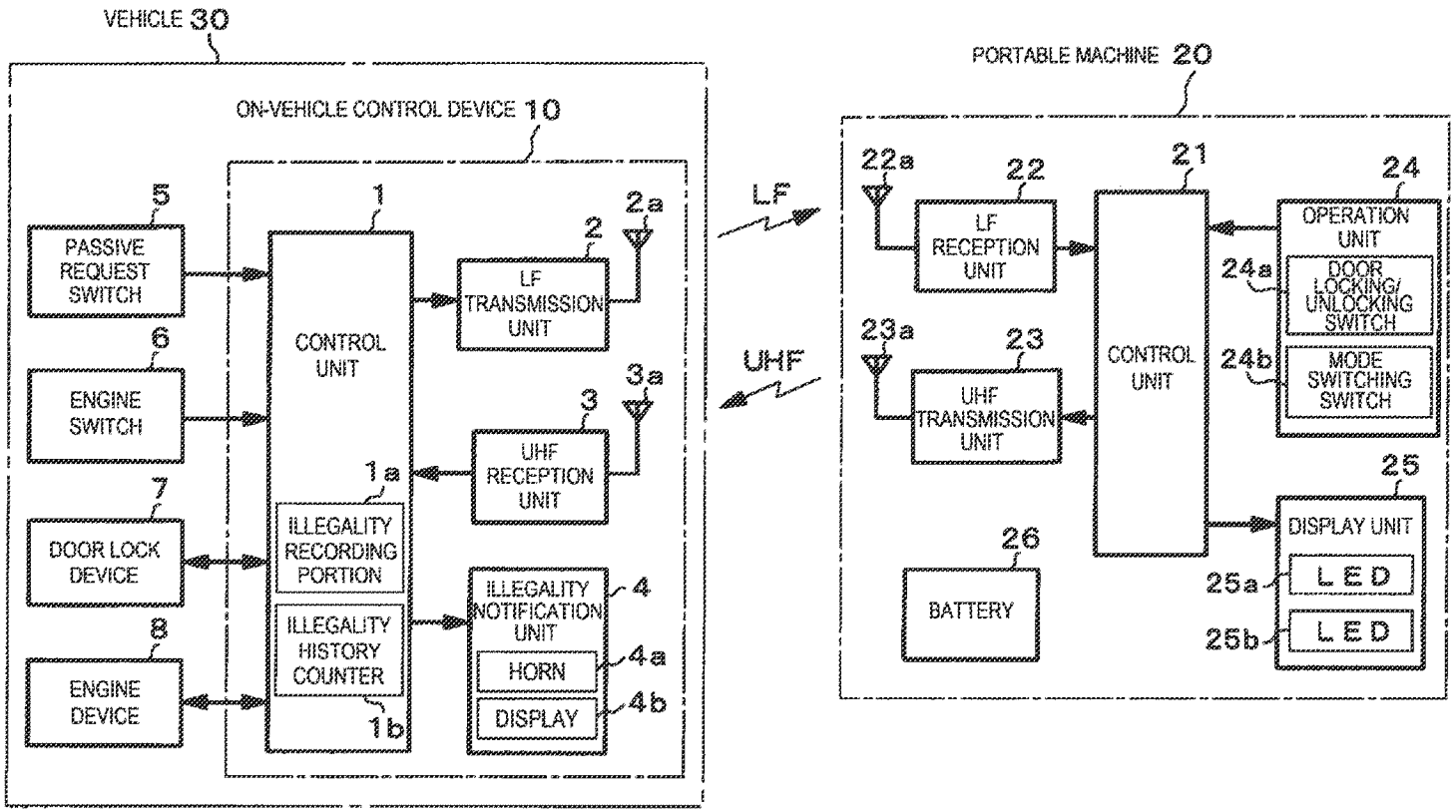
FIG. 1 is a configuration diagram of an on-vehicle apparatus control system according to embodiments of the present invention.

In embodiments of the invention, numerous specific details are set forth in order to provide a thorough understanding of the invention. However, it will be apparent to one of ordinary skill in the art that the invention may be practiced without these specific details. In other instances, well-known features have not been described in detail to avoid obscuring the invention.

Hereinafter, embodiments of the present invention will be described with reference to the drawings. The same portions or corresponding portions are given the same reference numerals throughout the drawings.

First, with reference to FIG. 1, a description will be made of a configuration of an on-vehicle apparatus control system 100 according to an embodiment.

FIG. 1 is a diagram illustrating a configuration of the on-vehicle apparatus control system 100. The on-vehicle apparatus control system 100 includes an on-vehicle control device 10 and a portable machine 20. In the on-vehicle apparatus control system 100, control on an on-vehicle apparatus mounted on a vehicle 30 is performed on the basis of radio signals which are transmitted and received between the on-vehicle control device 10 and the portable machine 20.

In the present embodiment, the control on an on-vehicle apparatus indicates control on a door lock device 7 which locks or unlocks a door of the vehicle 30. The vehicle 30 is formed of an automatic four-wheel vehicle. The vehicle 30 is provided, as doors which can be locked and unlocked, with a door of a driver seat, a door of a passenger seat, doors of rear seats, and a hack door (not illustrated).

The on-vehicle control device 10, a passive request switch 5, an engine switch 6, the door lock device 7, and an engine device 8 are mounted on the vehicle 30. The portable machine 20 is carried by a user of the vehicle 30.

The on-vehicle control device 10 includes a control unit 1, a low frequency (LF) transmission unit 2, an ultra high frequency (UHF) reception unit 3, and an illegality notification unit 4.

The control unit 1 is formed of a CPU, a memory, and the like. The control unit 1 includes an illegality recording portion 1*a* and an illegality history counter 1*b*. The illegality recording portion 1*a* records illegality history by using the illegality history counter 1*b* in a case where relay attack using a relay is performed on the vehicle 30.

The LF transmission unit 2 is formed of an LF transmission antenna 2*a*, a transmission signal processing portion (not illustrated), and the like, and is provided on a vehicle exterior and a vehicle interior of the vehicle 30. The LF transmission unit 2 transmits an LF signal generated by the transmission signal processing portion to the portable machine 20 located in or outside the vehicle interior via the LF transmission antenna 2*a*. The LF signal transmitted from the LF transmission unit 2 includes a response request signal for the portable machine 20.

The UHF reception unit 3 is formed of a UHF reception antenna 3*a*, a reception signal processing portion (not illustrated), and the like. The UHF reception unit 3 receives UHF signals transmitted from the portable machine 20 by using the UHF reception antenna 3*a* and the reception signal processing portion. The UHF signals received by the UHF reception unit 3 include a response signal, an illegality notification signal, and a remote control signal transmitted from the portable machine 20.

The control unit 1 controls the LF transmission unit 2 and the UHF reception unit 3 so as to wirelessly communicate with the portable machine 20, and transmits and receives signals or information to and from the portable machine 20.

The illegality notification unit 4 is provided with a horn 4*a* and a display 4*b*. The horn 4*a* outputs a warning sound to the outside of the vehicle. The display 4*b* is provided near the driver seat. In a case where relay attack using a relay is performed on the vehicle 30, the illegality notification unit 4 generates notification indicating the occurrence of illegality by outputting a warning sound from the horn 4*a* or displaying the illegality on the display 4*b*.

The passive request switch 5, the engine switch 6, the door lock device 7, and the engine device 8 are connected to the on-vehicle control device 10.

The passive request switch 5 is operated to lock or unlock the respective doors of the vehicle 30. The passive request switch 5 is provided on an outer knob (outer surface) of each door of the vehicle 30.

The engine switch 6 is provided around the driver seat in the vehicle interior of the vehicle 30. The engine switch 6 is operated in order to start and stop the engine. The control unit 1 detects operation states of the respective switches 5 and 6 on the basis of output signals from the switches 5 and 6.

The door lock device 7 is formed of a mechanism locking and unlocking the respective doors of the vehicle 30, and a driving circuit of the mechanism. The door lock device 7 is an example of an "on-vehicle apparatus" according to one or more embodiments of the present invention. The engine device 8 is formed of a starter motor starting the engine of the vehicle 30, a driving circuit of the starter motor, and the like.

The portable machine 20 is formed of an FOB key. The portable machine 20 includes a control unit 21, an LF reception unit 22, a UHF transmission unit 23, an operation unit 24, a display unit 25, and a battery 26.

The respective units 21 to 25 of the portable machine 20 are driven with power from the battery 26. The control unit 21 is formed of a CPU, a memory, and the like.

The LF reception unit 22 is formed of an LF reception antenna 22*a*, a reception signal processing portion (not illustrated), and the like. The LF reception unit 22 receives an LF signal transmitted from the on-vehicle control device 10 via the LF reception antenna 22*a*. The LF signal received by the LF reception unit 22 includes the above-described response request signal.

The UHF transmission unit 23 is formed of a UHF transmission antenna 23*a*, a transmission signal processing portion (not illustrated), and the like. The UHF transmission unit 23 transmits UHF signals generated by the transmission signal processing portion to the on-vehicle control device 10 via the UHF transmission antenna 23*a*. The UHF signals transmitted by the UHF transmission unit 23 include the response signal and the illegality notification signal.

The control unit 21 controls the LF reception unit 22 and the UHF transmission unit 23 so as to wirelessly communicate with the on-vehicle control device 10, and thus transmits and receives signals or information to and from the on-vehicle control device 10.

The operation unit 24 is provided with operation switches 24*a* and 24*b* operated by the user. The reference numeral 24*a* indicates a door locking/unlocking switch, and the reference numeral 24*b* indicates a mode switching switch. The control unit 21 detects operation states of the respective switches on the basis of output signals from the switches 24*a* and 24*b*.

The door locking/unlocking switch 24*a* is operated to lock or unlock each door of the vehicle 30. If the door locking/unlocking switch 24*a* is operated, the control unit 21 generates a remote control signal corresponding to the operation, and transmits the remote control signal to the on-vehicle control device 10 by using the UHF transmission unit 23. In other words, the UHF signals transmitted by the UHF transmission unit 23 also include the remote control signal.

The mode switching switch 24*b* is operated to select a permission mode or a prohibition mode. In the permission mode, control of locking or unlocking of the door of the vehicle 30 is permitted. In the prohibition mode, control of locking or unlocking of the door of the vehicle 30 is prohibited. The mode switching switch 24*b* is an example of a "mode switching unit" according to one or more embodiments of the present invention.

As another example, the mode switching switch 24*b* may be omitted, and the door locking/unlocking switch 24*a* may also be used as a mode switching switch. In this case, for example, when the door is locked or unlocked, a normal push operation may be performed on the door locking/unlocking switch 24*a*, and when switching between the permission mode and the prohibition mode is performed, an operation aspect may be changed, such as a long push operation or a two-push operation on the door locking/unlocking switch 24*a*. The control unit 21 may determine a door locking or unlocking instruction and a mode switching, instruction on the basis of an operation state of the door locking/unlocking switch 24*a*.

The display unit 25 is provided with a plurality of light emitting diodes (LEDs) 25*a* and 25*b*. Lighting colors of the LEDs 25*a* and 25*b* may be different from each other. The display unit 25 displays that the present mode of the portable machine 20 is the permission mode or the prohibition mode through lighting of at least one of the LEDs 25*a* and 25*b*.

As described above, if the user operates the door locking/unlocking switch 24*a*, the control unit 21 generates a remote control signal corresponding to the operation, and transmits the remote control signal to the on-vehicle control device 10 from the UHF transmission unit 23. The remote control signal includes an ID code (identification information) of the portable machine 20. If the UHF reception unit 3 of the on-vehicle control device 10 receives the remote control signal, the control unit 1 collates the ID code of the portable machine 20 included in the remote control signal with an ID code of the on-vehicle control device 10 stored in advance. In a case where the collation between the ID codes is successful (both of the ID codes match each other), the control unit 1 controls the door lock device 7 to lock or unlock the door of the vehicle 30 on the basis of the remote control signal (keyless entry method).

In a case where the portable machine 20 is in the permission mode, if the user carrying the portable machine 20 comes close to the vehicle 30, and operates any one of the passive request switches 5, the control unit 1 of the on-vehicle control device 10 transmits a response request signal to the portable machine 20 from the LF transmission unit 2. If the response request signal is received by the LF reception unit 22, the control unit 21 of the portable machine 20 returns a response signal to the on-vehicle control device 10 from the UHF transmission unit 23. The response signal includes the ID code of the portable machine 20. If the response signal is received by the UHF reception unit 3 of the on-vehicle control device 10, the control unit 1 collates the ID code of the portable machine 20 included in the response signal with the ID code of the on-vehicle control device 10. In a case where the collation between the ID codes is successful, the control unit 1 controls the door lock device 7 on the basis of the response signal so as to lock or unlock the door of the vehicle 30 (passive entry method).

If the user carrying the portable machine 20 operates the engine switch 6 in the vehicle interior of the vehicle 30, the control unit 1 performs communication with the LF reception unit 22 and the UHF transmission unit 23 of the portable machine 20 by using the LF transmission unit 2 and the UHF reception unit 3, and collates the ID code of the on-vehicle control device 10 and the ID code of the portable machine 20. If the collation between the ID codes is successful, the control unit 1 controls the engine device 8 to start (or stop) the engine of the vehicle 30.

However, relays (not illustrated) used for relay attack have a function of relaying transmission and reception of a signal between the on-vehicle control device 10 and the portable machine 20, even if the portable machine 20 is far away from the vehicle 30. As a result, during passive entry, the portable machine 20 which is far away is disguisedly located near the vehicle 30, and thus illegal communication is performed.

Next, an operation of the portable machine 20 will be described with reference to FIG. 2.

Figure 2:
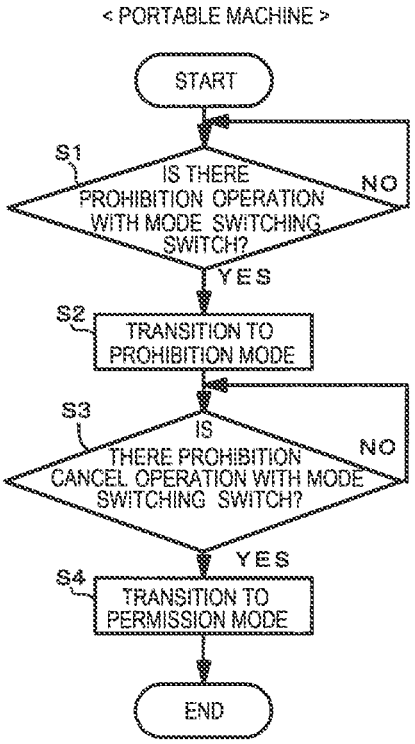
FIG. 2 is a flowchart illustrating a mode switching operation of a portable machine according to the embodiments of the present invention.

FIG. 2 is a flowchart illustrating an operation of the portable machine 20. Specifically, FIG. 2 illustrates a mode switching operation of the portable machine 20.

In an initial state, the portable machine 20 is in the permission mode. If the user performs a predetermined prohibition operation with the mode switching switch 24*b* of the operation unit 24 (YES in step S1 in FIG. 2), the control unit 21 transitions to the prohibition mode for prohibiting locking and unlocking of the door of the vehicle 30 (step S2 in FIG. 2). If the user performs an operation of canceling the prohibition mode with the mode switching switch 24*b* (YES in step S3 in FIG. 2), the control unit 21 transitions to the permission mode for permitting locking and unlocking of the door of the vehicle 30 (step S4 in FIG. 2).

Next, a description will be made of operations of the on-vehicle control device 10 and the portable machine 20 according to the first embodiment with reference to FIG. 3.

Figure 3:
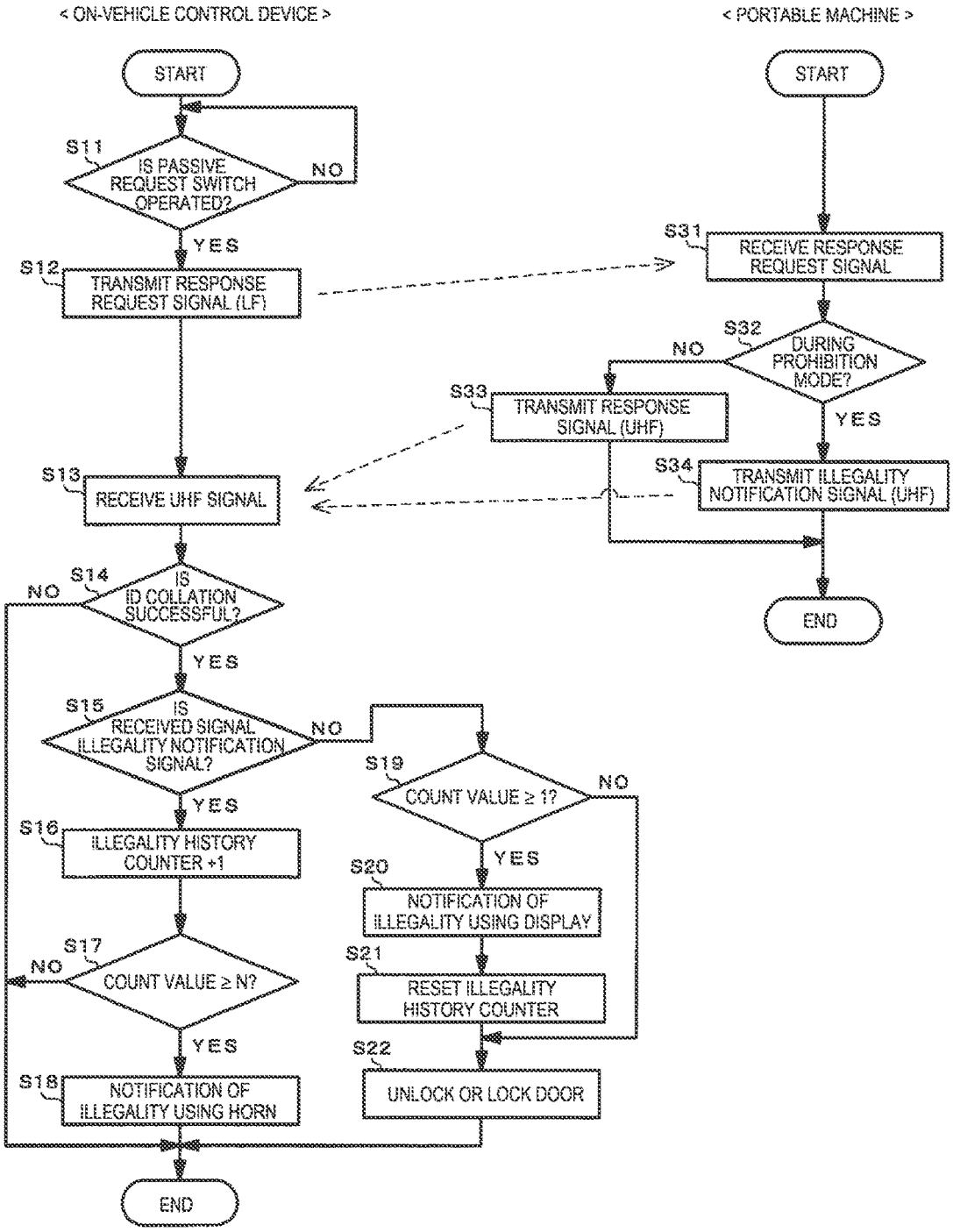
FIG. 3 is a flowchart illustrating operations of an on-vehicle control device and a portable machine according to a first embodiment of the present invention.

FIG. 3 is a flowchart illustrating operations of the on-vehicle control device 10 and the portable machine 20 according to the first embodiment. This example shows operations of the on-vehicle control device 10 and the portable machine 20 during passive entry. In this example, it is assumed that the portable machine 20 is located outside the vehicle interior of the vehicle 30, and the engine of the vehicle 30 is stopped (this is also the same for other embodiments which will be described later).

If the passive request switch 5 of the vehicle 30 is operated (YES in step S11 in FIG. 3), the control unit 1 of the on-vehicle control device 10 transmits a response request signal (LF signal) from the LF transmission unit 2 to the portable machine 20 (step S12 in FIG. 3).

If the response request signal transmitted from the on-vehicle control device 10 is received by the LF reception unit 22 of the portable machine 20 (step S31 in FIG. 3), the control unit 21 checks the present mode. At this time, if the present mode is the permission mode (NO in step S32 in FIG. 3), the control unit 21 transmits a response signal (UHF signal) to the on-vehicle control device 10 from the UHF transmission unit 23 (step S33 in FIG. 3).

In contrast, if the present mode of the portable machine 20 is the prohibition mode (YES in step S32 in FIG. 3), the control unit 21 transmits an illegality notification signal (UHF signal) to the on-vehicle control device 10 from the UHF transmission unit 23 (step S34 in FIG. 3).

This is because, the passive request switch 5 is operated and thus the response request signal is transmitted from the on-vehicle control device 10 despite the prohibition mode for prohibiting locking and unlocking of the door being set by the user. In other words, since it can be estimated that the response request signal is not based on an operation of an legal user but based on an illegal operation (relay attack) of a malicious third party, in step S34, the illegality notification signal is transmitted to the on-vehicle control device 10 from the portable machine 20 instead of the normal response signal (step S33). This illegality notification signal also includes the ID code of the portable machine 20.

If the UHF signal (the response signal or the illegality notification signal) transmitted from the portable machine 20 is received by the UHF reception unit 3 of the on-vehicle control device 10 (step S13 in FIG. 3), the control unit 1 collates the ID code of the portable machine 20 included in the UHF signal with the ID code of the on-vehicle control device 10. Here, if the collation between the ID codes fails (both of the ID codes do not match each other) (NO in step S14 in FIG. 3), the process is finished. In this case, the door of the vehicle 30 is not locked or unlocked by the door lock device 7, and illegality history is not recorded by the illegality recording portion 1*a*.

In contrast, if the collation between the ID codes is successful (both of the ID codes match each other) (YES in step S14 in FIG. 3), the control unit 1 checks the received UHF signal. If the received UHF signal is the illegality notification signal (YES in step S15 in FIG. 3), the illegality history counter 1*b* is counted up by one, and illegality history is recorded in the illegality recording portion 1*a* (step S16 in FIG. 3). As mentioned above, the illegality history counter 1*b* counts the number of times of reception of the illegality notification signal. The illegality recording portion 1*a* records a reception situation of the illegality notification signal as illegality history on the basis of a count value of the illegality history counter 1*b*.

Next, the control unit 1 refers to the illegality history counter 1*b*. Here, if the count value (the number of times of reception of the illegality notification signal) of the illegality history counter 1*b* is less than a predetermined number of times N (NO in step S17 in FIG. 3), the control unit 1 finishes the process without locking and unlocking the door of the vehicle 30 with the door lock device 7.

In contrast, if the count value of the illegality history counter 1*b* is equal to or more than the predetermined number of times N (YES in step S17 in FIG. 3), the control unit 1 outputs a warning sound from the horn 4*a* of the illegality notification unit 4 so as to generate the notification indicating that there is illegality (step S18). Also in this case, the process is finished without locking and unlocking the door of the vehicle 30 with the door lock device 7.

If the UHF signal received in step S13 in FIG. 3 is the response signal (NO in step S15 in FIG. 3), the control unit 1 refers to the illegality history counter 1*b*.

In this case, if a count value of the illegality history counter 1*b* is equal to or more than 1 (YES in step S19 in FIG. 3), the control unit 1 displays the illegality history recorded in the illegality recording portion 1*a* on the display 4*b* of the illegality notification unit 4, so as to generate the notification indicating that there is illegality (step S20 in FIG. 3). Specifically, for example, a count value of the illegality history counter 1*b* is displayed on the display 4*b* as the number of times of relay attack for a predetermined period of time. Thereafter, the control unit 1 resets a count value of the illegality history counter 1*b* (returns the count value to 0) (step S21 in FIG. 3). The control unit 1 controls the door lock device 7 to lock or unlock the door of the vehicle 30 on the basis of the response signal (step S22 in FIG. 3).

In contrast, if a count value of the illegality history counter 1*b* is not equal to or more than 1, that is, 0 (NO in step S19 in FIG. 3), the control unit 1 immediately controls the door lock device 7 to lock or unlock the door of the vehicle 30 on the basis of the response signal (step S22 in FIG. 3).

According to the first embodiment, when the user does not use the vehicle 30, the user operates the mode switching switch 24*b* of the portable machine 20 to perform switching to the prohibition mode. Then, even if a malicious third party performs relay attack using a relay, and a response request signal is transmitted to the on-vehicle control device 10 and is received by the portable machine 20, the portable machine 20 transmits an illegality notification signal instead of a response signal. If the on-vehicle control device 10 receives the illegality notification signal, locking and unlocking of the door is not controlled, and thus it is possible to stop relay attack. If the on-vehicle control device 10 receives the illegality notification signal, illegality history is recorded in the illegality recording portion 1*a*, and thus a trace of relay attack can be left. Thus, the user is aware of the vehicle 30 of the user being targeted by a malicious third party by referring to the illegality history (a count value of the illegality history counter 1*b*) of the illegality recording portion 1*a*, and can thus take an appropriate crime prevention action.

In the first embodiment, since a user is notified that relay attack is performed during the prohibition mode by using the horn 4*a* and the display 4*b* of the illegality notification unit 4, the user can be easily aware of the relay attack being performed on the vehicle 30 of the user and can thus take an appropriate crime prevention action.

In the first embodiment, a user can easily select the permission mode for permitting control of locking and unlocking of the door of the vehicle 30 or the prohibition mode for prohibiting the control by operating the mode switching switch 24*b* of the portable machine 20.

In the first embodiment, the on-vehicle control device 10 is provided with the illegality recording portion 1*a* and the illegality notification unit 4, the illegality recording portion 1*a* records a situation of receiving an illegality notification signal in the UHF reception unit 3 of the on-vehicle control device 10 as illegality history, and the illegality notification unit 4 generates the notification indicating that there is illegality on the basis of the recorded content. Thus, the user can understand a situation of relay attack being performed during the prohibition mode in the vehicle 30.

In the first embodiment, the illegality history counter 1*b* counts the number of times of reception of an illegality notification signal in the UHF reception unit 3, and, if a count value is equal to or more than a predetermined number N, the illegality notification unit 4 outputs a warning sound from the horn 4*a* so as to generate the notification indicating that there is illegality. Thus, even if the user is not in the vehicle 30, the user can easily and immediately recognize that relay attack is performed for the predetermined number of times or more during the prohibition mode.

In the first embodiment, when the on-vehicle control device 10 receives a response signal, the illegality notification unit 4 generates the notification indicating a count value of the illegality history counter 1*b* as the number of times of relay attack through display on the display 4*b*. Thus, when the user gets in the vehicle 30, the user visually recognizes the display content on the display 4*b*, and can thus easily and immediately recognize the number of times of relay attack being performed during the previous prohibition mode.

Next, a description will be made of operations of the on-vehicle control device 10 and the portable machine 20 according to the second embodiment with reference to FIGS. 4 and 5.

Figure 4:
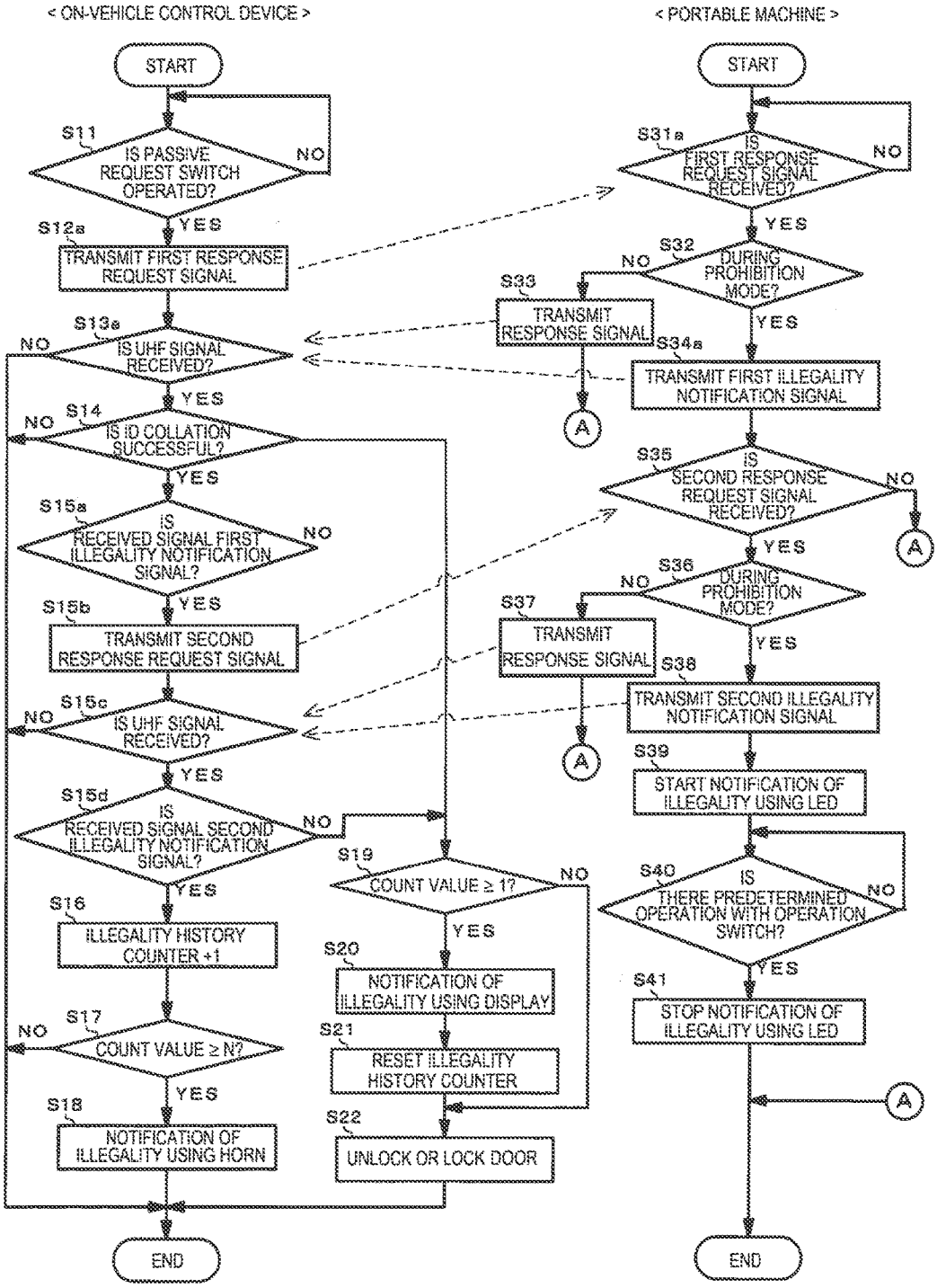
FIG. 4 is a flowchart illustrating operations of an on-vehicle control device and a portable machine according to a second embodiment of the present invention.

FIG. 4 is a flowchart illustrating operations of the on-vehicle control device 10 and the portable machine 20 according to the second embodiment. This example shows operations of the on-vehicle control device 10 and the portable machine 20 during passive entry. FIGS. 5A to 5D are diagrams illustrating formats of signals transmitted from the on-vehicle control device 10 and the portable machine 20 according to the second embodiment.

If the passive request switch 5 is operated (YES in step S11 in FIG. 4), the control unit 1 of the on-vehicle control device 10 transmits a first response request signal from the LF transmission unit 2 to the portable machine 20 (step S12*a* in FIG. 4).

Figure 5A:
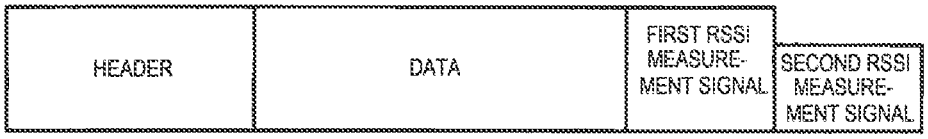
FIGS. 5A to 5D are diagrams illustrating formats of signals transmitted from the on-vehicle control device and the portable machine according to the second embodiment of the present invention.

A format of the first response request signal is a normal format, and is formed of, as illustrated in FIG. 5A, a header, data, a first RSSI (received signal intensity) measurement signal, and a second RSSI measurement signal. The first RSSI measurement signal and the second RSSI measurement signal are signals for measuring the received signal intensity of a response request signal in the portable machine 20.

If the LF reception unit 22 of the portable machine 20 receives the first response request signal transmitted from the on-vehicle control device 10 (YES in step S31*a* in FIG. 4), the control unit 21 checks the present mode. At this time, if the present mode is the permission mode (NO in step S32 in FIG. 4), the control unit 21 transmits a first response signal to the on-vehicle control device 10 from the UHF transmission unit 23 (step S33 in FIG. 4).

In contrast, if the present mode of the portable machine 20 is the prohibition mode (YES in step S32 in FIG. 4), the control unit 21 transmits a first illegality notification signal to the on-vehicle control device 10 from the UHF transmission unit 23 (step S34*a* in FIG. 4).

Figure 5B:
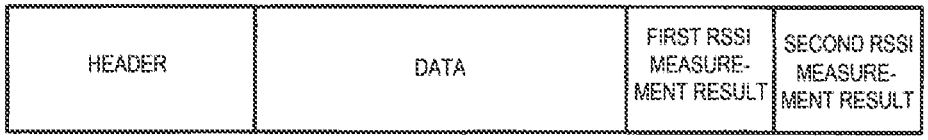

As illustrated in FIG. 5B, a format of the first illegality notification signal is formed of a header, data, a first RSSI measurement result, and a second RSSI measurement result. The first RSSI measurement result and the second RSSI measurement result respectively indicate results of the received signal intensity of the first RSSI measurement signal and the received signal intensity of the second RSSI measurement signal included in a response request signal being measured by the reception signal processing portion of the LF reception unit 22 when the LF reception unit 22 receives the response request signal.

If the UHF signal transmitted from the portable machine 20 is received by the UHF reception unit 3 of the on-vehicle control device 10 (YES in step S13*a* in FIG. 4), the control unit 1 collates the ID code of the portable machine 20 included in the UHF signal with the ID code of the on-vehicle control device 10. Here, if the collation between the ID codes is successful (YES in step S14 in FIG. 4), the control unit 1 checks the received UHF signal.

If the received UHF signal is the first response signal (NO in step S15*a* in FIG. 4), the control unit 1 refers to the illegality history counter 1*b*. In this case, if a count value of the illegality history counter 1*b* is equal to or more than 1 (YES in step S19 in FIG. 4), the control unit 1 displays the illegality history recognized by the illegality recording portion 1*a* on the display 4*b* of the illegality notification unit 4, so as to generate the notification indicating that there is illegality (step S20 in FIG. 4). Thereafter, the control unit 1 resets a count value of the illegality history counter 1*b* (step S21 in FIG. 4). The control unit 1 controls the door lock device 7 to lock or unlock the door of the vehicle 30 on the basis of the response signal (step S22 in FIG. 4).

If the received UHF signal is the first illegality notification signal in step S15*a* in FIG. 4 (YES in step S15*a* in FIG. 4), the control unit 1 transmits a second response request signal to the portable machine 20 from the LF transmission unit 2 (step S15*b* in FIG. 4). In other words, retry of transmission of the response request signal is performed.

Figure 5C:
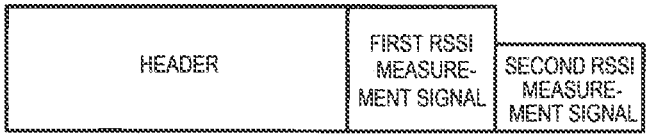

A format of the second response request signal is a format for rechecking relay attack, and is formed of, as illustrated in FIG. 5C, a header, a first RSSI measurement signal, and a second RSSI measurement signal. As mentioned above, the format of the second response request signal is different from the format of the first response request signal illustrated in FIG. 5A, and a signal length of the second response request signal is smaller than a signal length of the first response request signal by omission of data.

If the second response request signal transmitted from the on-vehicle control device 10 is received by the LF reception unit 22 of the portable machine 20 (YES in step S35 in FIG. 4), the control unit 21 checks the present mode. At this time, if the present mode is the permission mode (NO in step S36 in FIG. 4), the control unit 21 transmits a second response signal to the on-vehicle control device 10 from the UHF transmission unit 23 (step S37 in FIG. 4).

In contrast, if the present mode of the portable machine 20 is the prohibition mode (YES in step S36 in FIG. 4), the control unit 21 transmits a second illegality notification signal to the on-vehicle control device 10 from the UHF transmission unit 23 (step S38 in FIG. 4).

Figure 5D:
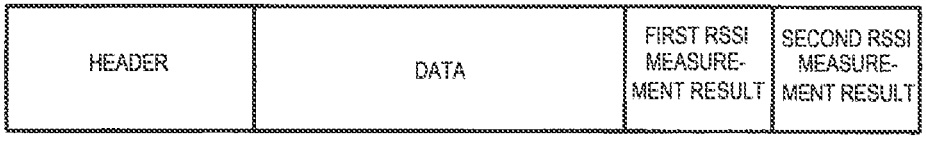

As illustrated in FIG. 5D, a format of the second illegality notification signal is formed of a header, data, a first RSSI measurement result, and a second RSSI measurement result. As mentioned above, the format of the second illegality notification signal is the same as the format of the first illegality notification signal illustrated in FIG. 5B, and a signal length thereof is the same as the signal length of the first illegality notification signal.

Next, the control unit 21 starts to generate the notification indicating that there is illegality (relay attack) through lighting of at least one of the LEDs 25*a* and 25*b* of the display unit 25 (step S39 in FIG. 4). The display unit 25 is an example of an "illegality notification unit" according to one or more embodiments of the present invention.

Thereafter, if a predetermined operation is performed with the operation switches 24*a* and 24*b* of the operation unit 24 (YES in step S40 in FIG. 4), the control unit 21 stops the notification of illegality using the display unit 25 (step S41 in FIG. 4). Specifically, the LED 25*a* or the LED 25*b* is put out.

If the UHF signal transmitted again from the portable machine 20 is received again by the UHF reception unit 3 of the on-vehicle control device 10 (YES in step S15*c* in FIG. 4), the control unit 1 checks the UHF signal. If the received UHF signal is the second response signal (NO in step S15*d* in FIG. 4), the control unit 1 performs step S19 to step S22 in FIG. 4 as described above.

If the received UHF signal is the second illegality notification signal in step S15*c* in FIG. 4 (YES in step S15*d* in FIG. 4), the illegality history counter 1*b* is counted up by one, and thus illegality history is recorded in the illegality recording portion 1*a* (step S16 in FIG. 4).

The control unit 1 refers to the illegality history counter 1*b*, and, if a count value of the illegality history counter 1*b* is less than a predetermined number of times N (NO in step S17 in FIG. 4), the control unit 1 finishes the process without locking and unlocking the door of the vehicle 30 with the door lock device 7.

In contrast, if the count value of the illegality history counter 1*b* is equal to or more than the predetermined number of times N (YES in step S17 in FIG. 4), the control unit 1 outputs a warning sound from the horn 4*a* of the illegality notification unit 4 so as to generate the notification indicating that there is illegality (step S18). Also in this case, the process is finished without locking and unlocking the door of the vehicle 30 with the door lock device 7.

According to the second embodiment, if the on-vehicle control device 10 receives an illegality notification signal from the portable machine 20 in response to a first response request signal which is transmitted in response to reception of an operation on the passive request switch 5, the reception is not recorded in the illegality recording portion 1*a* as illegality history at this point, and a second response request signal is transmitted. If the illegality notification signal is received again with respect to the second response request signal without receiving a response signal, the reception is recorded in the illegality recording portion 1*a* as illegality history. In other words, in a case where the on-vehicle control device 10 continuously receives the illegality notification signal transmitted from the portable machine 20 twice, that is, relay attack is continuously performed twice during the prohibition mode, illegality history is recorded in the illegality recording portion 1*a*. Thus, matching of illegality history recorded in the illegality recording portion 1*a* can be taken.

In the second embodiment, the format of the second response request signal transmitted by the on-vehicle control device 10 is different from the format of the first response request signal, and the signal length of the second response request signal is smaller than the signal length of the first response request signal. Thus, it is possible to reduce a response time until the second response signal is received from transmission of the second response request signal.

In the second embodiment, the display unit 25 of the portable machine 20 is used as an illegality notification unit, and, in a case where the UHF transmission unit 23 continuously transmits an illegality notification signal twice, the notification of illegality is generated through lighting of the LEDs 25*a* and 25*b* of the display unit 25. Thus, even if the user carrying the portable machine 20 is far away from the vehicle 30, the user can easily recognize that relay attack is performed during the prohibition mode by viewing lighting states of the LEDs 25*a* and 25*b*, and can thus take an appropriate crime prevention action. Whether the present mode is the permission mode or the prohibition mode is displayed by using the LEDs 25*a* and 25*b*, and thus the user can check the present mode by viewing the LEDs 25*a* and 25*b*.

The present invention may employ various embodiments other than the above-described embodiments. For example, in the second embodiment illustrated in FIG. 4, a description has been made of an example in which the notification of illegality is generated by the display unit 25 in a case where the portable machine 20 continuously transmits an illegality notification signal twice during the prohibition mode, but the present invention is not limited thereto. For example, when the portable machine 20 transmits an illegality notification signal during the prohibition mode, the notification of illegality may be generated by the display unit 25.

Figure 6:
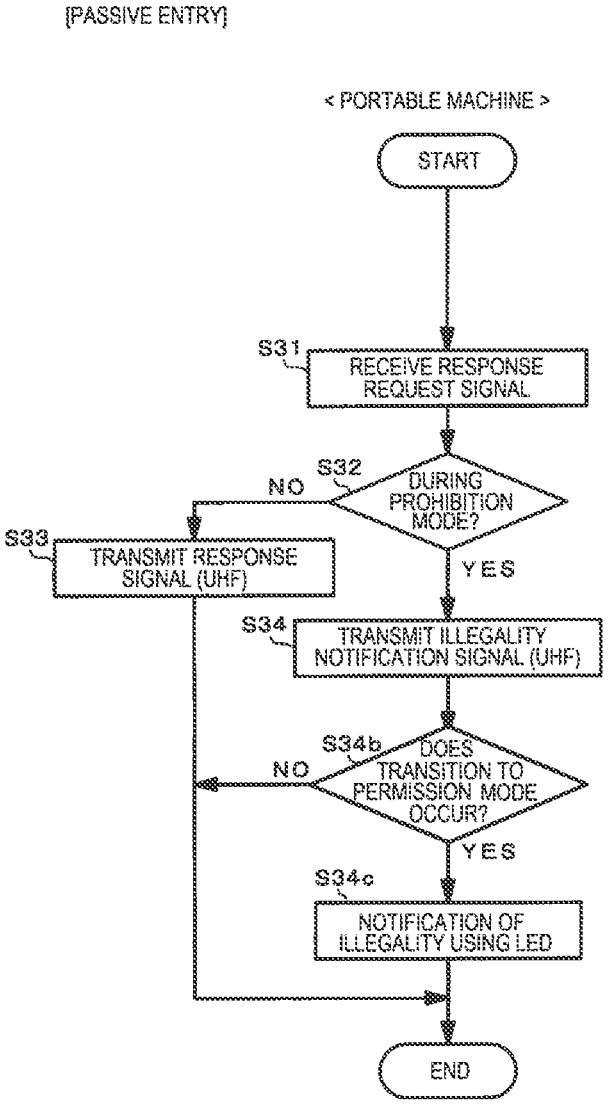
FIG. 6 is a flowchart illustrating an operation of a portable machine according to another embodiment of the present invention.

For example, as in another embodiment illustrated in FIG. 6, when the portable machine 20 transmits an illegality notification signal (step S34 in FIG. 6) and then transitions to the permission mode (YES in step S34*b* in FIG. 6), the notification indicating that there is illegality with the display unit 25 may be generated (step S34*c* in FIG. 6). Specifically, for example, a notification of illegality is performed by lighting at least one of the LEDs 25*a* and 25*b* of the display unit 25 for a predetermined period of time. Alternatively, a notification of illegality is performed by lighting at least one of the LEDs 25*a* and 25*b*, and then the LEDs 25*a* and 25*b* are put out when a predetermined operation is performed by using the operation switches 24*a* and 24*b* of the operation unit 24.

In the above-described embodiments, a description has been made of an example in which illegality history is recorded in the illegality recording portion 1*a* by counting up the illegality history counter 1*b* by one in a case where the on-vehicle control device 10 receives an illegality notification signal, but the present invention is not limited thereto. Every time the on-vehicle control device receives an illegality notification signal, the reception date and time thereof may be recorded in a memory as an illegality history log. Consequently, it is possible to understand the number of times of performed relay attack and the date and time of performed relay attack by referring to the illegality history log.

In the above-described embodiments, a description has been made of an example in which the mode switching switch 24*b* which is a mode switching unit and the display unit 25 which is an illegality notification unit are provided in the portable machine 20, and the illegality recording portion 1*a* and the illegality notification unit 4 are provided in the on-vehicle control device 10, but the present invention is not limited thereto. Each of the mode switching unit, the illegality recording portion, and the illegality notification unit may be provided in at least one of the portable machine and the on-vehicle control device. For example, in a case where the mode switching unit is provided in the on-vehicle control device, a switching result in the mode switching unit may be transmitted from the on-vehicle control device to the portable machine through wireless communication. For example, in a case where the illegality recording portion is provided in the portable machine, when the portable machine receives a response request signal during the prohibition mode, the illegality recording portion may record illegality history, and then the recorded content in the illegality recording portion may be transmitted from the portable machine to the on-vehicle control device through wireless communication.

In the first embodiment and the second embodiment, a description has been made of operations of the on-vehicle control device 10 and the portable machine 20 during passive entry as an example, but the present invention is applicable to a case of polling, for example.

Figure 7:
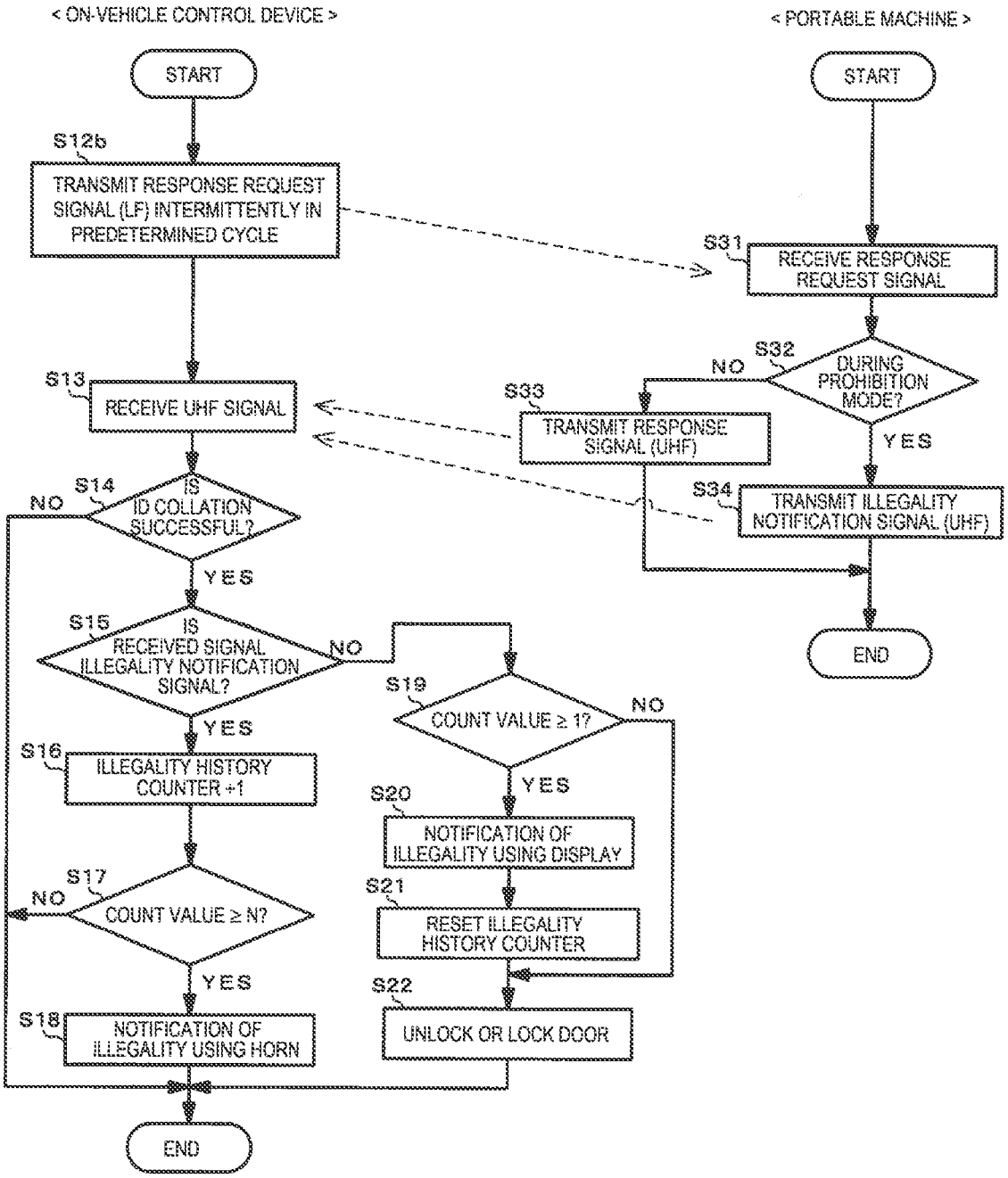
FIG. 7 is a flowchart illustrating operations of an on-vehicle control device and a portable machine according to yet another embodiment of the present invention.
Figure 8:
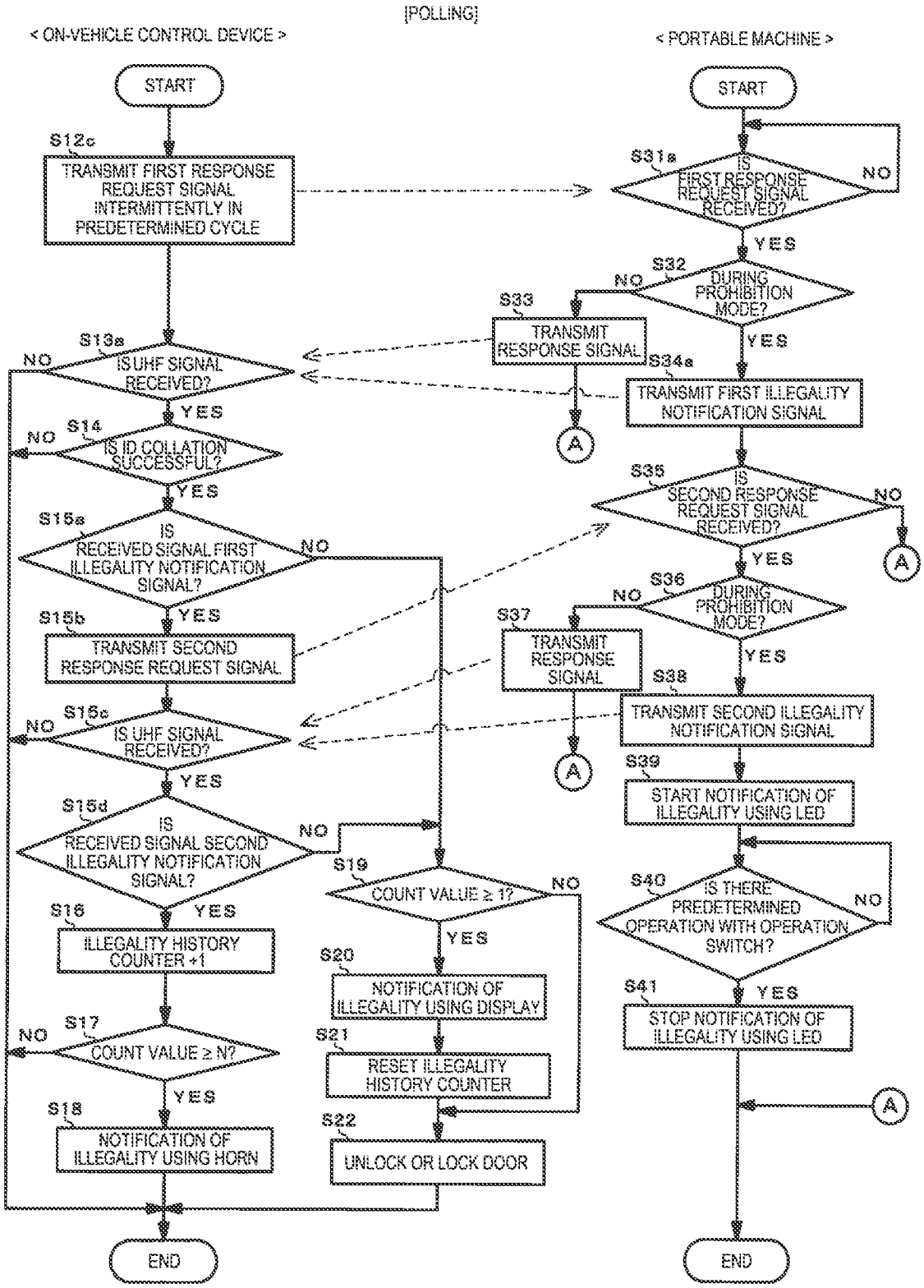
FIG. 8 is a flowchart illustrating operations of an on-vehicle control device and a portable machine according to yet another embodiment of the present invention.

According to other embodiments, FIGS. 7 and 8 are flowcharts illustrating operations of an on-vehicle control device and a portable machine during polling.

In the example illustrated in FIG. 7, first, the on-vehicle control device voluntarily transmits a response request signal intermittently in a predetermined cycle (step S12*b* in FIG. 7). The subsequent steps are the same as those in the first embodiment illustrated in FIG. 3.

In the example illustrated in FIG. 8, first, the on-vehicle control device voluntarily transmits a first response request signal intermittently in a predetermined cycle (step S12*c* in FIG. 8). The subsequent steps are the same as those in the second embodiment illustrated in FIG. 4. A second response request signal (step S15*b* in FIG. 8) may be transmitted only once, and may be transmitted for a plurality of number of times intermittently in a predetermined cycle.

In the above-described embodiments, as an example of control on an on-vehicle apparatus performed by the on-vehicle apparatus control system 100, locking or unlocking of the doors of the vehicle 30 performed by the door lock device 7 has been described, but the present invention is not limited thereto. For example, control on other on-vehicle apparatuses mounted on the vehicle, such as starting of the engine performed by the engine device 8, driving of an air conditioner performed by an air conditioner device (not illustrated), and driving of an audio apparatus using an audio system (not illustrated) may be performed.

In the above-described embodiments, a description has been made of an example in which the present invention is applied to the on-vehicle apparatus control system 100, the on-vehicle control device 10, and the portable machine 20 for an automatic four-wheel vehicle, but the present invention is also applicable to an on-vehicle apparatus control system, an on-vehicle control device, and a portable machine for other vehicles such as a motorcycle or a large vehicle.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. An on-vehicle apparatus control system comprising:

an on-vehicle control device that is mounted on a vehicle; and a portable machine that is carried by a user, wherein the on-vehicle control device transmits a response request signal, wherein the portable machine transmits a response signal if the portable machine receives the response request signal, wherein the on-vehicle control device controls an on-vehicle apparatus mounted on the vehicle on a basis of the response signal if the on-vehicle control device receives the response signal, wherein the on-vehicle apparatus control system comprises:

a mode switching unit that selects a permission mode or a prohibition mode; and an illegality recording portion that records transmission or reception of the response request signal as illegality history in a case where the response request signal is transmitted from the on-vehicle control device or is received by the portable machine during the prohibition mode, wherein if the response request signal transmitted from the on-vehicle control device is received by the portable machine during the permission mode, the portable machine transmits the response signal, and wherein if the response request signal transmitted from the on-vehicle control device is received by the portable machine during the prohibition mode, the portable machine transmits an illegality notification signal instead of the response signal, and the on-vehicle control device does not control the on-vehicle apparatus if the illegality notification signal is received.

2. The on-vehicle apparatus control system according to claim 1, further comprising:

an illegality notification unit that generates a notification indicating that there is illegality in a case where the response request signal is transmitted from the on-vehicle control device or is received by the portable machine during the prohibition mode.

3. The on-vehicle apparatus control system according to claim 1, wherein the mode switching unit comprises an operation switch provided in the portable machine, and selects the permission mode or the prohibition mode through a predetermined operation on the operation switch.

4. The on-vehicle apparatus control system according to claim 2, wherein the illegality recording portion and the illegality notification unit are provided in the on-vehicle control device, wherein the illegality recording portion records a situation of receiving the illegality notification signal in the on-vehicle control device as the illegality history, and wherein the illegality notification unit generates the notification indicating that there is illegality on a basis of the recorded content in the illegality recording portion.

5. The on-vehicle apparatus control system according to claim 4, wherein in a case where a number of times of reception of the illegality notification signal recorded in the illegality recording portion is equal to or more than a predetermined number, the illegality notification unit outputs a warning.

6. The on-vehicle apparatus control system according to claim 2, wherein when the on-vehicle control device receives the response signal, the illegality notification unit generates a notification of the illegality history recorded in the illegality recording portion.

7. The on-vehicle apparatus control system according to claim 4, wherein the on-vehicle control device initially transmits a first response request signal, transmits a second response request signal if the illegality notification signal is received in response to the first response request signal, and records the illegality history in the illegality recording portion if the illegality notification signal is received in response to the second response request signal.

8. The on-vehicle apparatus control system according to claim 7, wherein a format of the second response request signal transmitted from the on-vehicle control device is different from a format of the first response request signal, and a signal length of the second response request signal is smaller than a signal length of the first response request signal.

9. An on-vehicle control device mounted on a vehicle, the on-vehicle control device comprising:

a transmission unit that transmits a response request signal to a portable machine carried by a user;

a reception unit that receives a response signal transmitted from the portable machine in response to reception of the response request signal; and a control unit that controls an on-vehicle apparatus mounted on the vehicle on a basis of the response signal if the reception unit receives the response signal, wherein the control unit controls the on-vehicle apparatus on a basis of the response signal if the response signal transmitted from the portable machine in response to the response request signal is received when the portable machine is in a permission mode, wherein the control unit does not control the on-vehicle apparatus if an illegality notification signal transmitted from the portable machine in response to the response request signal is received when the portable machine is in a prohibition mode, and wherein the on-vehicle control device further comprises an illegality recording portion records the illegality history on a basis of the illegality notification signal.

10. A portable machine carried by a user of a vehicle, the portable machine comprising:

a reception unit that receives a response request signal transmitted from an on-vehicle control device mounted on the vehicle;

a transmission unit that transmits a response signal for the on-vehicle control device controlling an on-vehicle apparatus mounted on the vehicle to the on-vehicle control device; and a mode switching unit that selects a permission mode or a prohibition mode, wherein the transmission unit transmits the response signal to the on-vehicle control device if the reception unit receives the response request signal during the permission mode, and wherein the transmission unit transmits an illegality notification signal for the on-vehicle control device recording illegality history to the on-vehicle control device instead of the response signal if the reception unit receives the response request signal during the prohibition mode.

* * * * *